US008056611B2

(12) United States Patent
Gildemeister et al.

(10) Patent No.: US 8,056,611 B2
(45) Date of Patent: Nov. 15, 2011

(54) PROCESS AND APPARATUS FOR DIRECT CHILL CASTING

(75) Inventors: David R. Gildemeister, Murrysville, PA (US); James L. Kirby, Mechanicsville, VA (US); Ray T. Richter, Murrysville, PA (US); Charles W. Shanko, Summerville, SC (US)

(73) Assignee: Alcoa Inc., Pittsburgh, PA (US)

( * ) Notice: Subject to any disclaimer, the term of this patent is extended or adjusted under 35 U.S.C. 154(b) by 265 days.

(21) Appl. No.: 12/245,951

(22) Filed: Oct. 6, 2008

(65) Prior Publication Data

US 2010/0084109 A1 Apr. 8, 2010

(51) Int. Cl.
*B22D 11/049* (2006.01)
*B22D 11/124* (2006.01)

(52) U.S. Cl. ..... 164/444; 164/487

(58) Field of Classification Search ..... 164/487, 164/444

See application file for complete search history.

(56) References Cited

U.S. PATENT DOCUMENTS 4,693,296 A * 9/1987 King ..... 164/440
5,176,197 A * 1/1993 Hamaguchi et al. ..... 164/459
5,518,063 A * 5/1996 Wagstaff et al. ..... 164/444

FOREIGN PATENT DOCUMENTS

GB 2 082 950 A * 3/1982

* cited by examiner

*Primary Examiner* — Kevin P Kerns
(74) *Attorney, Agent, or Firm* — Greenberg Traurig, LLP

(57) ABSTRACT

In one embodiment, an apparatus for direct chill casting of metal includes an open ended mold cavity formed by a casting surface with an upper end and a lower end, a refractory sleeve located at the upper end of the mold cavity being adapted to receive molten metal, a coolant delivery system below the lower end of the mold for supplying coolant to chill the descending hot metal body, and a boron nitride ring mounted between the refractory sleeve and the peripheral wall of the mold cavity. Another embodiment further includes a down-spout instead of a refractory sleeve that is located at the upper end of the mold cavity being adapted to receive molten metal having a flow control rod or a floating baffle where the flow control rod controls the amount of molten metal to enter the mold cavity.

5 Claims, 4 Drawing Sheets

PROCESS AND APPARATUS FOR DIRECT CHILL CASTING

BACKGROUND OF THE INVENTION

In one embodiment, the present invention relates to a process and apparatus for direct chill casting of molten metal, such as aluminum. In another embodiment, the present invention related to a process and apparatus for direct chill castings using a boron nitride mold insert. In further embodiment, the use of the boron nitride mold insert or ring for round ingot casting eliminates the need for the use of a lubricant between the mold and the solidifying ingot. In another embodiment, the process and apparatus is for direct chill casting round ingots. While boron nitride inserts have been specifically discussed for round ingot molds, such a boron nitride insert may also prove beneficial for use in other shapes of ingot mold applications.

SUMMARY OF THE INVENTION

In one embodiment, the present invention provides an apparatus for direct chill casting of metal comprising an open ended mold cavity formed by a casting surface with an upper end and a lower end, a refractory sleeve located at the upper end of the mold cavity being adapted to receive molten metal, a coolant delivery system below the lower end of the mold for supplying coolant to chill the descending hot metal body, and a boron nitride ring mounted between the refractory sleeve and the peripheral wall of the mold cavity.

In another embodiment, the present invention provides an apparatus where the boron nitride ring substantially prevents the metal from adhering to the wall of the mold.

In a further embodiment, the refractory sleeve of the direct chill apparatus has an inner diameter less than the inner diameter of the mold whereby the sleeve forms an overhang with the mold cavity.

In another embodiment, the present invention provides an apparatus where the coolant is water. In a yet another embodiment, the present invention provides an apparatus where the metal is essentially pure aluminum or an aluminum alloy.

In another embodiment, the apparatus for direct chill casting of metal comprising an open ended mold cavity formed by a casting surface with an upper end and a lower end, a downspout located at the upper end of the mold cavity being adapted to receive molten metal having a flow control rod or a floating baffle, a coolant delivery system below the lower end of the mold for supplying coolant to chill the descending hot metal body, and a boron nitride ring on the upper end of the mold cavity where the flow control rod or the floating baffle controls the amount of molten metal to enter the mold cavity.

In another embodiment, the present invention provides an apparatus where the coolant is water. In a yet another embodiment, the present invention provides an apparatus where the metal is aluminum alloy.

In yet further embodiment, the present invention provide a process for the direct chill casting of a metal comprising the steps of continuously filling the upper end of the cavity with molten metal and permitting the molten metal to move downwardly through the mold to form an ingot and simultaneously chilling the ingot by spraying coolant on the ingot from the coolant delivery system.

In another embodiment, the present invention provides a process where the coolant is water. In a yet another embodiment, the present invention provides a process where the metal is aluminum alloy.

Accordingly, it is one embodiment of the invention to provide a process and apparatus for direct chill castings using a boron nitride mold insert and/or ring.

These and other further embodiments of the invention will become more apparent through the following description and drawing.

BRIEF DESCRIPTION OF THE DRAWINGS

For a fuller understanding of the invention, reference is made to the following description taken in connection with the accompanying drawing(s), in which.

DETAILED DESCRIPTION OF THE PREFERRED EMBODIMENTS

The present invention discloses an apparatus for direct chill casting of metal comprising an open ended mold cavity formed by a casting surface with an upper end and a lower end, a refractory sleeve located at the upper end of the mold cavity being adapted to receive molten metal, a coolant delivery system below the lower end of the mold for supplying coolant to chill the descending hot metal body, and a boron nitride ring mounted between the refractory sleeve and the peripheral wall of the mold cavity.

The followings are the definitions of the terms used in this application. As used herein, the term "substantially" means to a great extent or degree.

Figure 1:
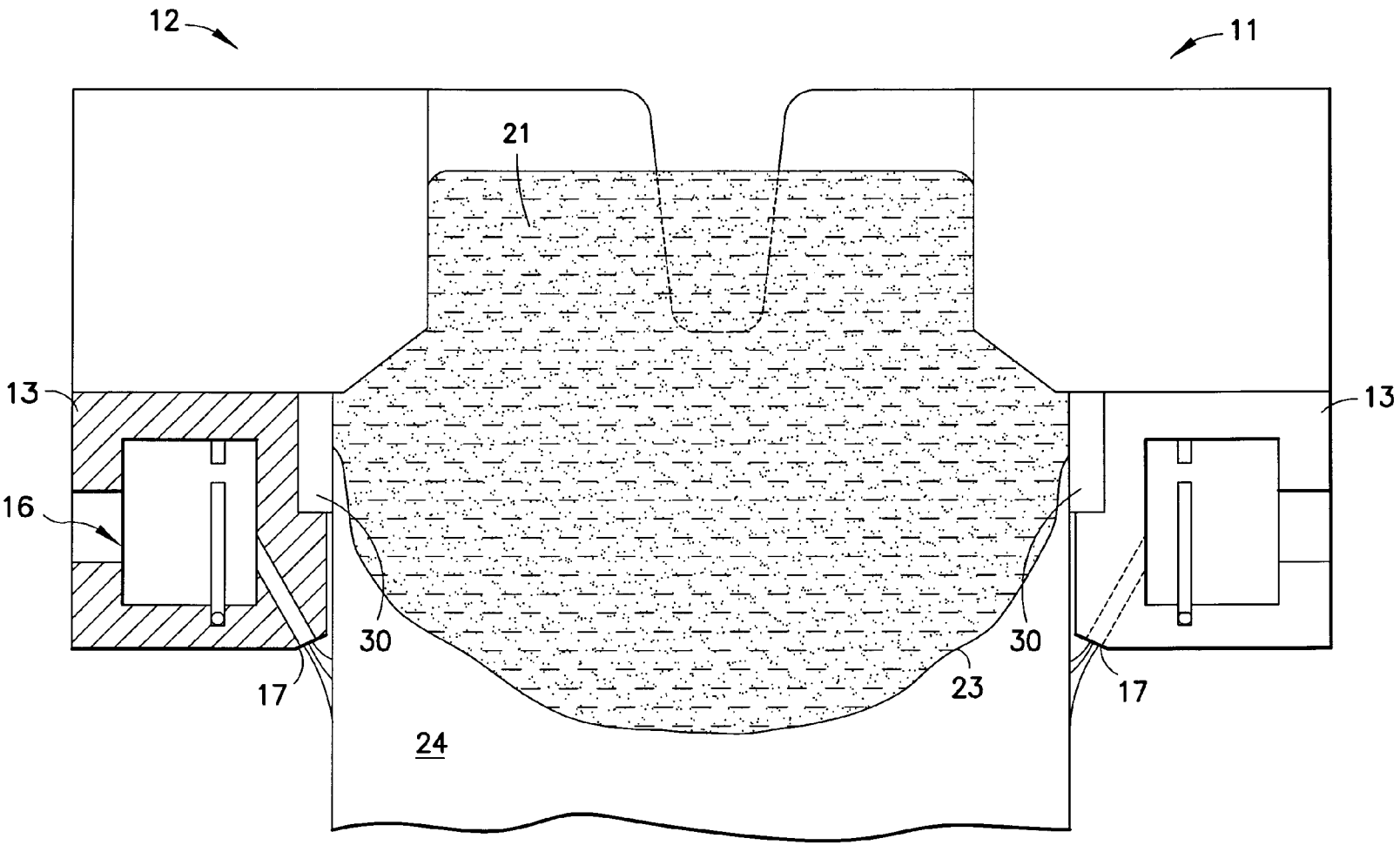
FIG. 1 is a vertical cross section of a mold according to one embodiment of the present invention.

FIG. 1 shows a vertical cross section of a mold in accordance with one embodiment of the invention.

Here one or more casting mold bodies 13 may be sealed to a mold table (not shown) by means of o-rings. A hot top basin or a refractory sleeve 12 supplies molten metal to mold body 13. Mold body 13 has an annular coolant channel 16 with a series of coolant delivery holes 17 drilled between the channel and the lower inner surface of the mold body 13 to deliver coolant to an ingot surface (shown in dotted lines) as it is withdrawn from the mold. Here, the coolant is water. Other mold body designs may have internal water channels within the mold body rather than on the surface as shown, and water may be delivered to the ingot surface by means of a slot or slots rather than holes. Optionally, a pair of refractory rings (not shown) is provided in an annular space in the upper portion of the mold body 13. A refractory fibre gasket fills any remaining gaps.

Here, molten metal 21 enters mold cavity by refractory sleeve 12. As the molten metal solidifies, it creates a meniscus 23. The metal below the meniscus is solidified metal 24 to create an initial frozen ingot butt, at which time the stool cap of the mold is lowered simultaneously so that an ingot can develop.

A solid boron nitride annular ring 30 is mounted within the mold body 13. Optionally, a gas supply inlet (not shown) is provided in the mold table either just above or just below boron nitride annular ring 30.

Suitable types of boron nitride that may be used to make the annular ring include, but are not limited to, pyrolytic, isostatically pressed and sintered. The dimension of the boron nitride ring depends on the size and shape of the molds used. For a boron nitride ring, the diameter of the ring may range from about 2 inches to about 50 inches.

Suitable types of coolant that may be used to cool the metal ingot include, but are not limited to, water, glycol or other appropriate liquid coolant.

In another embodiment, an apparatus for direct chill casting of metal is provided. The apparatus includes an open ended mold cavity formed by a casting surface with an upper end and a lower end, a downspout located at the upper end of the mold cavity being adapted to receive molten metal having a flow control rod, a coolant delivery system below the lower end of the mold for supplying coolant to chill the descending hot metal body, and a boron nitride ring mounted in the peripheral wall of the mold cavity.

Figure 2:
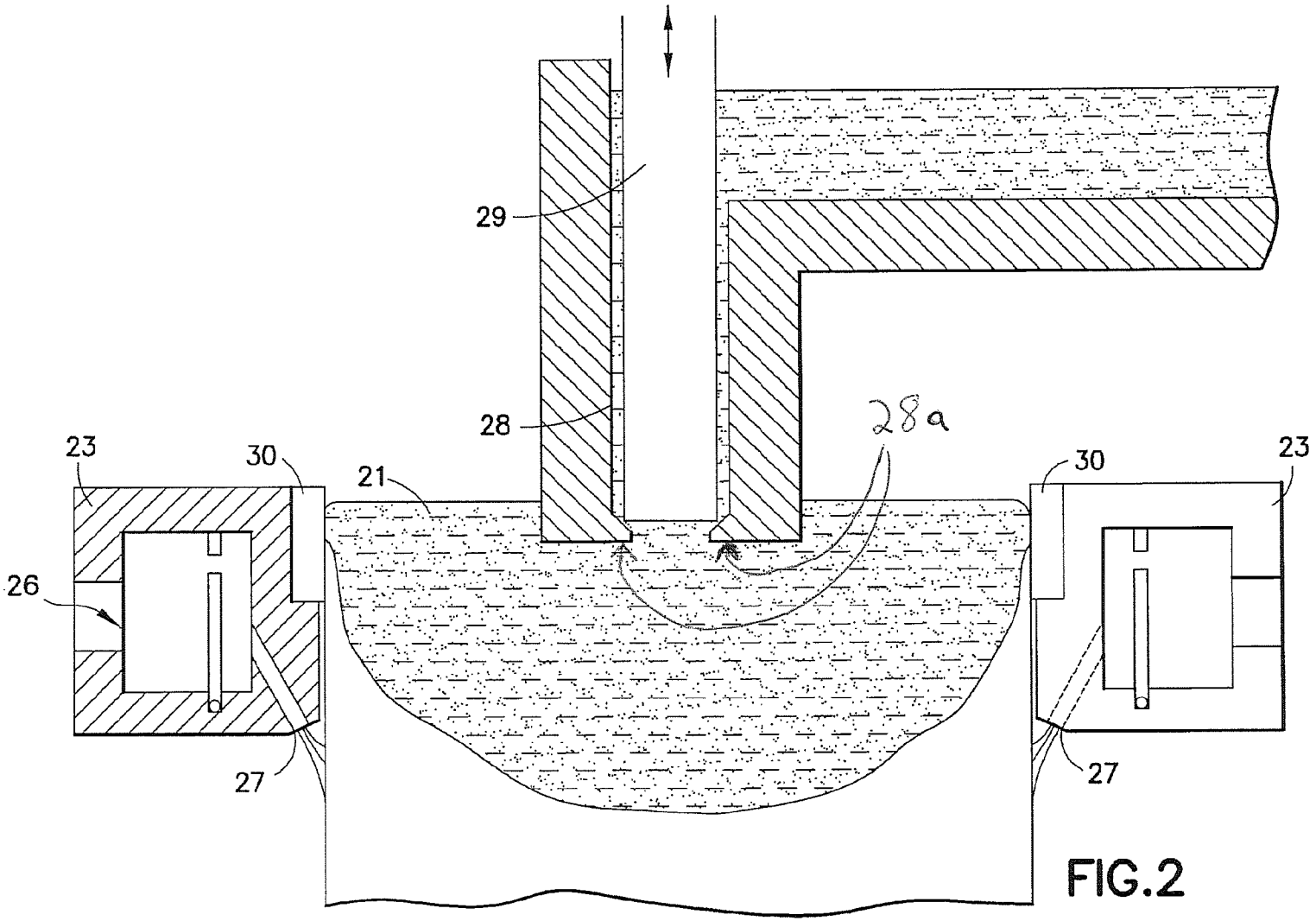
FIG. 2 is a vertical cross section of a mold according to another embodiment of the present invention.

FIG. 2 shows a one or more casting mold bodies 23 that may be sealed to a mold table (not shown) by means of o-rings. Here, a downspout 28 having a flow control rod 29 to control the rate of molten metal flow entering mold body 23. For instance, if the rate of molten metal flow entering mold body 23 is too great, flow control rod 29 may be pressed against opening 28*a* of downspout 28 to stop or slow the flow of molten metal into mold body 23. For instance, if the rate of molten metal flow entering mold body 23 is too slow, flow control rod 29 may be withdraw from opening 28*a* of downspout 28 to increase the flow of molten metal into mold body 23. The mold body 23 has an annular coolant channel 26 with a series of coolant delivery holes 27 drilled between the channel and the lower inner surface of the mold body 23 to deliver coolant to an ingot surface (shown in dotted lines) as it is withdrawn from the mold. Here, the coolant is water. Other mold body designs may have internal water channels within the mold body rather than on the surface as shown, and water may be delivered to the ingot surface by means of a slot or slots rather than holes.

A solid boron nitride annular ring 30 is mounted within the upper end of the mold body 23. Optionally, a gas supply inlet (not shown) is provided in the mold table either just above or just below boron nitride annular ring 30.

In another embodiment, the metal flow entering the mold body may be controlled by a floating baffle or any other appropriate means instead of a control rod to control the flow of metal into the mold and the level of molten metal within the mold.

Suitable types of boron nitride that may be used to make the annular ring include, but are not limited to, pyrolytic, isostatically pressed and sintered. The dimension of the boron nitride ring depends on the size and shape of the molds used. For a boron nitride ring, the diameter of the ring may range from about 2 inches to about 50 inches.

Suitable types of coolant that may be used to cool the metal ingot include, but are not limited to, water, glycol or any other appropriate liquid coolant.

Figure 3:
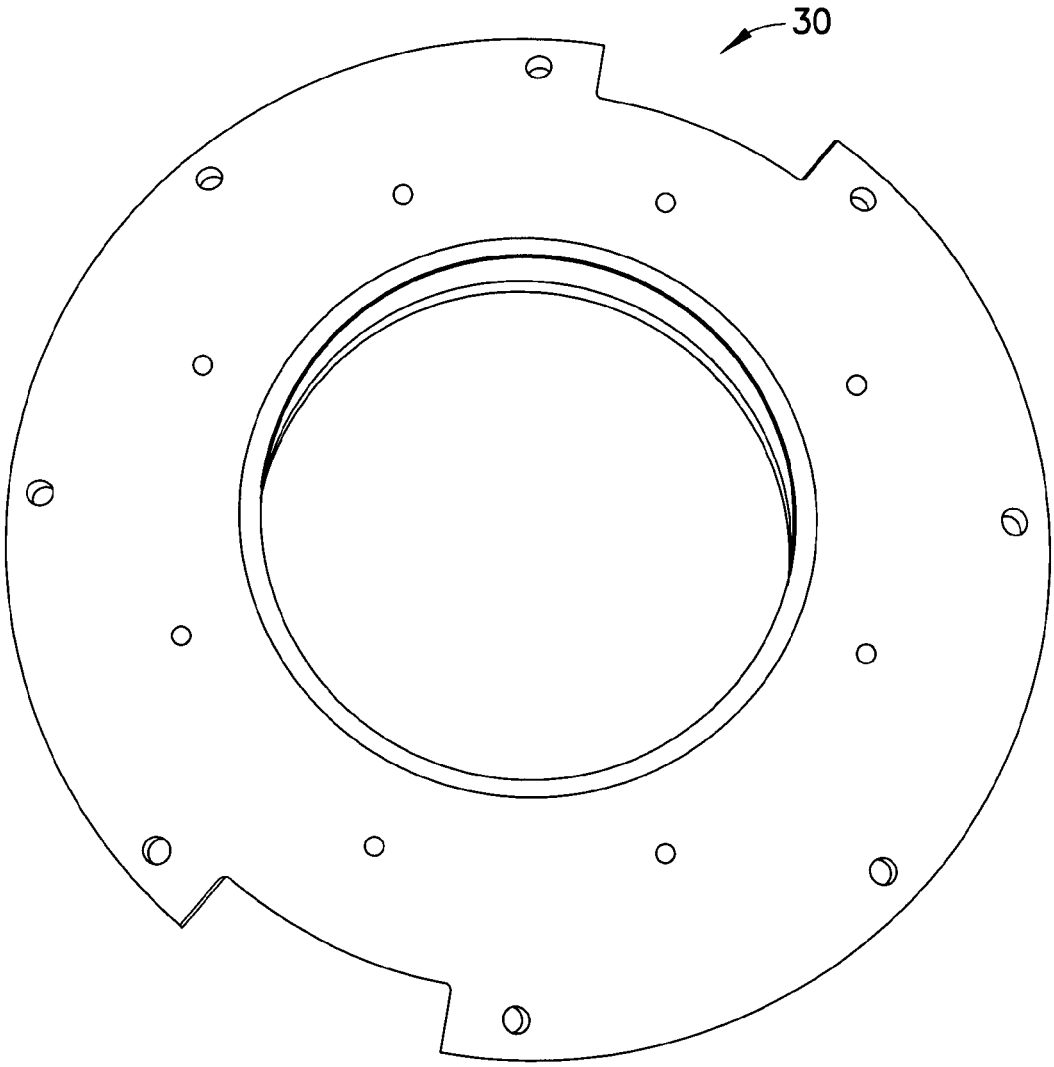
FIG. 3 is a perspective top view of the boron nitride ring according to one embodiment of the present invention.

FIG. 3 shows a top view of the boron nitride ring 30 in accordance with one embodiment of the present invention.

Figure 4:
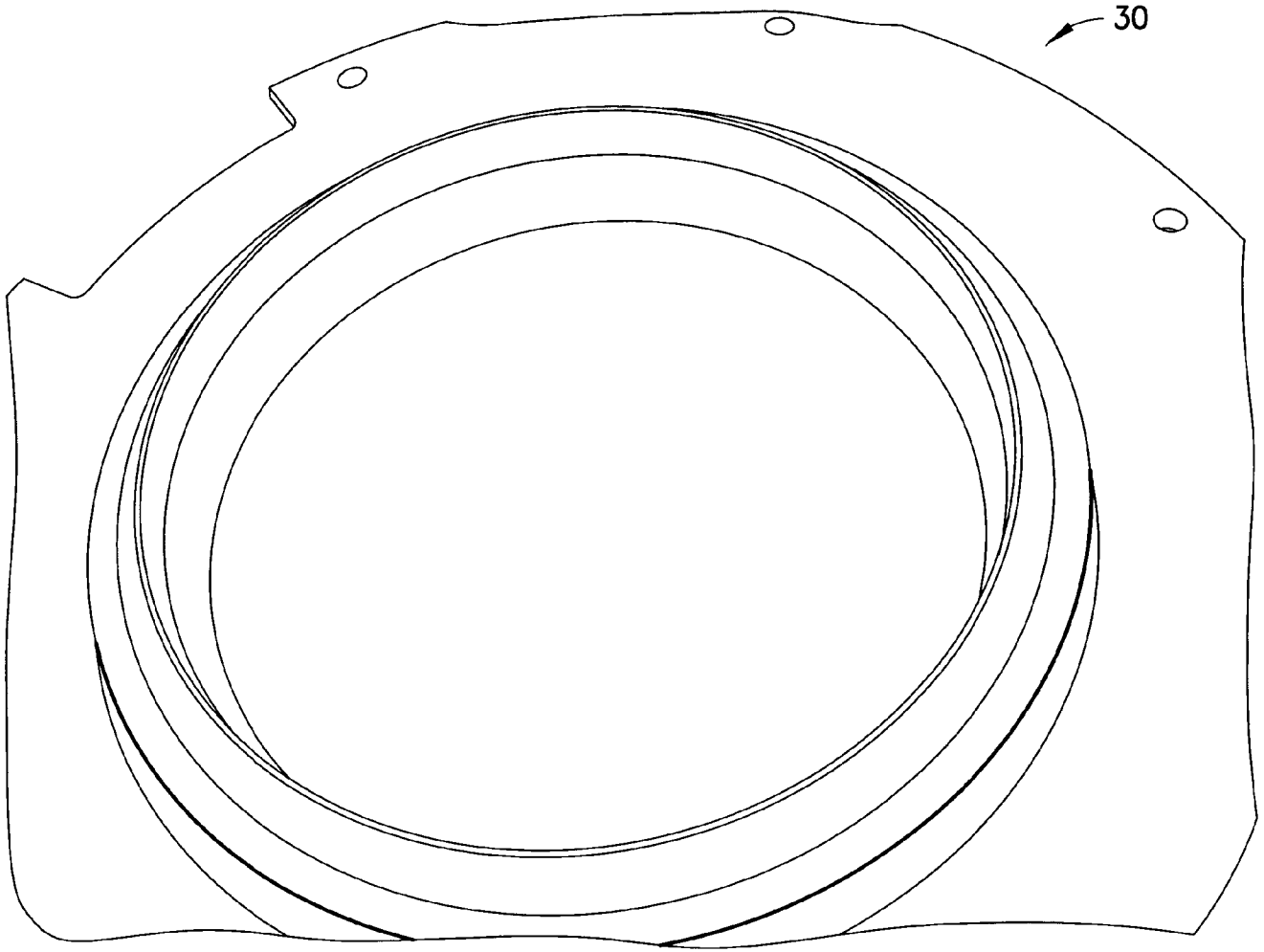
FIG. 4 is a perspective bottom view of the boron nitride ring of FIG. 3 according to one embodiment of the present invention.

FIG. 4 shows a bottom view of boron nitride ring 30 of FIG. 3 in accordance with one embodiment of the present invention.

The mold is typically used in the following manner. At the start of a direct chill cast, base plates or stool caps (not shown) are in position within the bottom of each mold body. Molten metal is delivered to the top of each mold cavity, for example, by means of a dip tube and float arrangement, or by means of refractory channels on top of the mold table (referred to as a level pour system). The metal then flows into the mold cavity and forms an initial frozen ingot butt, at which time the stool cap of the mold is lowered simultaneously so that an ingot can develop. The ingot is simultaneously chilled by spraying coolant on the ingot from the coolant delivery system. During the cast, the molten metal that starts to solidify contacts the boron nitride annular ring to prevent the molten metal from sticking to the mold.

Optionally, a small flow of gas such as a mixture of oxygen and nitrogen may be supplied to the interface between the solidifying ingot and the boron nitride casting ring. The flow of gas may create a stable pocket at the upper end of the casting ring and will exit between the annular space created between the casting ring/mold body and the solidifying and shrinking ingot. This creates a further reduction in the friction experienced by the developing ingot shell.

An example of using the boron nitride ring for casting aluminum where the mold diameter is 7 inches and an addition of 0.001-0.008 wt % titanium is made using commercially available grain refining rod. First, the coolant is water so the water delivery system is started at a water flow at between 15 to 30 gallons per minute per mold. Bottom blocks are engaged to 0.25" below born nitride ring in mold for starting. The mold is then filled with molten metal and held for 20 seconds before the cast started. The casting temperature was approximately 1250-1310° F. in trough near mold entrance. The water flow during casting ranged from 15 to 30 gallons per minute per mold and the casting speed ranged from 4.0 to 6.0 inches per minute. This produced an aluminum ingot that is equivalent to an ingot produced with a graphite ring and lubricant.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An apparatus for direct chill casting of aluminum or aluminum alloys comprising:

an open ended mold cavity formed by a casting surface with an upper end and a lower end;

a refractory sleeve located at the upper end of the mold cavity being adapted to receive molten aluminum;

a coolant delivery system below the lower end of the mold cavity for supplying coolant to chill the aluminum body as it descends through the refractory sleeve; and a co-continuous ring mounted between the refractory sleeve and the peripheral wall of the mold cavity, wherein the ring has a substantially uniform thickness, wherein the ring has a composition that is lubricious and insoluble in aluminum, wherein the ring is configured to separate the aluminum from the peripheral wall of the mold cavity.

2. The apparatus of claim 1, wherein the ring substantially prevents the aluminum from adhering to the wall of the mold.

3. The apparatus of claim 1, wherein the refractory sleeve of the direct chill apparatus has an inner diameter less than the inner diameter of the mold cavity whereby the sleeve forms an overhang with the mold cavity.

4. The apparatus of claim 1, wherein the coolant is water.

5. The apparatus of claim 1 wherein the ring is made of boron nitride.

* * * * *